US009291135B2

(12) United States Patent
Ohwada et al.

(10) Patent No.: US 9,291,135 B2
(45) Date of Patent: Mar. 22, 2016

(54) ELECTROMAGNETIC FUEL INJECTION VALVE

(75) Inventors: Hisashi Ohwada, Hitachi (JP); Tohru Ishikawa, Kitaibaraki (JP); Motoyuki Abe, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 871 days.

(21) Appl. No.: 13/502,878

(22) PCT Filed: Aug. 18, 2010

(86) PCT No.: PCT/JP2010/005090

§ 371 (c)(1),
(2), (4) Date: Apr. 19, 2012

(87) PCT Pub. No.: WO2011/048736

PCT Pub. Date: Apr. 28, 2011

(65) Prior Publication Data

US 2012/0204839 A1 Aug. 16, 2012

(30) Foreign Application Priority Data

Oct. 21, 2009 (JP) ..... 2009-241926

(51) Int. Cl.
*F02M 61/16* (2006.01)
*F02M 51/06* (2006.01)

(52) U.S. Cl.
CPC ..... *F02M 51/0614* (2013.01); *F02M 51/0671* (2013.01); *F02M 2200/9038* (2013.01)

(58) Field of Classification Search
CPC ..... F02M 51/0614; F02M 51/06741; F02M 2200/9038
See application file for complete search history.

(56) References Cited

U.S. PATENT DOCUMENTS 5,732,888 A * 3/1998 Maier et al. ..... 239/585.1
5,769,391 A * 6/1998 Noller et al. ..... 251/129.21

(Continued)

FOREIGN PATENT DOCUMENTS

CN 1212040 A 3/1999
CN 101025136 A 8/2007

(Continued)

OTHER PUBLICATIONS

Corresponding International Search Report with English Translation dated Nov. 2, 2010 (five (5) pages).

(Continued)

*Primary Examiner* — Thomas Moulis
(74) *Attorney, Agent, or Firm* — Crowell & Moring LLP

(57) ABSTRACT

Provided is an electromagnetic fuel injection valve such that the collision faces of a chrome-coated movable element with respect to a stationary core and a valve body are flat, and change in the fuel injection quantity can be suppressed. The electromagnetic fuel injection valve is provided with a movable element having a cylindrical structure, and a valve body which is separated from the movable element and provided on the hollow portion side of the movable element so as to reciprocate. The movable element has a first collision face which collides with an end face of a stationary core, and a second collision face which collides with an end face of the valve body, said first collision face and second collision face coated with a chrome coating layer, and said chrome coating layer applied by disposing a positive electrode on the center axis of the movable element. An inclined face having an inclination to compensate for the inclination of the inclined face obtained from the thickness of the chrome coating layer gradually increasing toward the center axis is formed on the end face of the base material of the movable element on which at least one of either the first collision face or the second collision face will be formed. The chrome coating layer is applied on the inclined face, so that at least one of either the first collision face or the second collision face is flat.

10 Claims, 4 Drawing Sheets

(56) References Cited

U.S. PATENT DOCUMENTS

| | | | | |
|---|---|---|---|---|
| 5,996,911 | A * | 12/1999 | Gesk et al. | 239/585.1 |
| 6,607,143 | B2 * | 8/2003 | Dallmeyer et al. | 239/5 |
| 6,676,044 | B2 * | 1/2004 | Dallmeyer et al. | 239/585.1 |
| 6,695,233 | B2 * | 2/2004 | Sekine et al. | 239/585.1 |
| 6,708,906 | B2 * | 3/2004 | Dallmeyer et al. | 239/585.1 |
| 7,051,960 | B2 * | 5/2006 | Oguma | 239/585.1 |
| 7,097,151 | B2 * | 8/2006 | Akabane | 251/129.18 |
| 7,422,160 | B2 * | 9/2008 | Dallmeyer | 239/5 |
| 7,429,006 | B2 * | 9/2008 | Dallmeyer | 239/585.1 |
| 8,104,698 | B2 * | 1/2012 | Hayatani et al. | 239/585.3 |
| 2006/0076437 | A1 | 4/2006 | Dallmeyer | |
| 2006/0214033 | A1 | 9/2006 | Koyanagi et al. | |
| 2007/0194151 | A1 | 8/2007 | Hayatani et al. | |
| 2008/0011886 | A1 | 1/2008 | Abe et al. | |
| 2009/0200405 | A1 | 8/2009 | Yoshimaru et al. | |

FOREIGN PATENT DOCUMENTS

| | | | |
|---|---|---|---|
| CN | 101105165 | A | 1/2008 |
| DE | 196 54 322 | A1 | 6/1998 |
| DE | 10 2006 012 981 | A1 | 9/2006 |
| EP | 1 820 959 | A1 | 8/2007 |
| EP | 1 878 908 | A2 | 1/2008 |
| GB | 2 337 300 | A | 11/1999 |
| JP | 8-69916 | A | 3/1996 |
| JP | 2000-505863 | A | 5/2000 |
| JP | 2000-265919 | A | 9/2000 |
| JP | 2005-36696 | A | 2/2005 |
| JP | 2007-218205 | A | 8/2007 |
| JP | 2008-19785 | A | 1/2008 |
| JP | 2008-508465 | A | 3/2008 |
| WO | WO 98/28537 | A1 | 7/1998 |
| WO | WO 2006/015221 | A1 | 2/2006 |

OTHER PUBLICATIONS

Extended European Search Report dated Jan. 8, 2014 (eleven (11) pages).

European Patent Office Communication dated Jan. 14, 2014 (Four (4) pages).

Machine Translation of JP 2005-36696 A, previously submitted as document B1 on Apr. 19, 2012 (Fifty-five (55) pages).

* cited by examiner

ELECTROMAGNETIC FUEL INJECTION VALVE

TECHNICAL FIELD

The present invention relates to an electromagnetic fuel injection valve that is used for an internal combustion engine of an automobile and the like. The electromagnetic fuel injection valve according to the present invention is applicable to a fuel injection valve used for a direct-injection internal combustion engine.

BACKGROUND ART

An electromagnetic fuel injection valve driven by an electrical signal from an engine control unit is used in an internal combustion engine of an automobile and the like. The electromagnetic fuel injection valve is configured to move a movable core so that a valve plug sits on a valve seat and leaves the valve seat for the purpose of accurately supplying fuel to the internal combustion engine and shutting off the supply of the fuel. A movable valve element, which comprises the movable core and the valve plug, can be moved by a magnetic attractive force generated between a stationary core and the movable core with an electromagnetic coil disposed around the stationary core and the movable core.

The movable core is attracted to the stationary core and leaves the stationary core by selective generation and non-generation of the magnetic attractive force, and an impact occurs between the movable core and the stationary core when the movable core is attracted to the stationary core.

Further, the movable core and the valve plug, which are engaged with each other, are configured so that they first are freed from each other and then impacts with each other, due to acceleration of them that is provided by the magnetic attractive force and a force of a return spring that presses the valve plug in a seating direction. In some of electromagnetic fuel injection valves, they have impact surfaces coated with a hard chromium film layer or the like to prevent them from being worn by such an impact.

Particularly, Patent Publication 1a discloses a method of coating end faces of the stationary core and the movable valve element, which includes the impact surface of the movable valve element, with a chromium film coat, and forming tapered surfaces on both the inner circumference side and outer circumference side of the impact surface for the purpose of reducing a liquid adhesion force between the stationary core and the movable valve plug, preventing the impact surface from being magnetized and providing improved response.

PRIOR ART LITERATURE

Patent Publication

Patent Publication 1: JP-A-2005-36696

SUMMARY OF THE INVENTION

Problem to be Solved by the Invention

In the electromagnetic fuel injection valve in Patent Publication 1, as far as the movable valve plug has a single impact surface and the impact surface has a limited width, it is effective for coating the impact surface with a chromium film coat having a relatively flat surface. However, in the electromagnetic fuel injection valve that the movable core and the valve plug of the movable valve element are formed independently from each other, and the movable core has a circular impact surface, which impacts with the stationary core, and an inner impact surface, which impacts with the valve plug, it is necessary to form a rigid chromium film layer on both an upper impact surface, which is an upper end face of the movable core to impact with the stationary core, and an inner impact surface, which is an inner end face of the movable core to impact the valve plug. Two methods may be used to form a chromium film layer on both the upper and the inner impact surfaces in the movable core. A first method is to perform a process for inserting a positive electrode into a central axis of the movable core and coating the upper impact surface of the movable core with a chromium film coat, and perform another process for inserting another positive electrode into the central axis of the movable core and coating the inner impact surface of the movable element with a chromium film coat. A second method is to perform a process for inserting a single positive electrode for chromium film coating into the central axis of the movable element and coating both the upper and the inner impact surfaces with a chromium film coat.

However, in either method, the current density concentrates on a part of an impact end face nearest the positive electrode. Therefore, the resulting chromium film layer does not have a uniform thickness so that the thickness of the chromium film layer gradually increases with a decrease in a distance to the positive electrode. As a result, the impact surface has a sloped surface of the chromium film layer. When the impact surface is not flat but sloped so that the thickness of the chromium film layer gradually increases toward the central axis of the movable core, the pressure-receiving area of the movable core is insufficient when it impacts with the stationary core or the valve plug. When the pressure-receiving area is insufficient, a plastic deformation may occur in the impact surface. This varies the distance over which the movable core or the valve plug axially reciprocates, thereby causing the amount of fuel injection to vary.

In order to solve the above problem, an object of the present invention is to provide an electromagnetic fuel injection valve capable of reducing fluctuations of fuel injection amount by flattening the chromium-coated impact surfaces of the movable core, that impacts with the stationary core or the valve plug, with little slope, at low cost.

Means for Solving the Problem

In order to achieve the above object, an electromagnetic fuel injection valve according to the present invention is configured as follows.

In the electromagnetic fuel injection valve having such a configuration that an end face of a movable valve element impacts with an end face of a stationary core due to an electromagnetic attractive force exerted when the valve opens, wherein the movable valve element comprises a movable core, which has a cylindrical structure, and a valve plug, which is formed separate from the movable core and retained on a hollow side of the movable core to reciprocate together with the movable core with the electromagnetic attractive force and a force of a return spring, wherein the movable core has a first impact surface, which impacts with the end face of the stationary core, and a second impact surface, which impacts with a retained surface of the valve plug, the first and second impact surfaces being coated with a chromium film layer, and the electromagnetic fuel injection valve is characterized in that the chromium film layer is formed of a plated layer, wherein an end face of a movable core base material, on which at least either the first impact surface or the second impact surface is formed, has a sloped surface having a reverse gradient amount with respect to a gradient amount of the chromium film layer whose thickness gradually increases toward a central axis line of the movable core, and thereby the chromium film layer is formed on the sloped surface of the end face of the movable core base material so that at least either the first impact surface or the second impact surface has a flat surface with little slope.

Effect of the Invention

According to the present invention, it is possible to reduce fuel injection amount fluctuations by flattening the chromium-coated impact surfaces of the movable core that impact with the stationary core or the valve plug, with little slope.

EMBODIMENTS FOR CARRYING OUT THE INVENTION

Preferred embodiments of the present invention will now be described with reference to accompanying drawings.

[First Embodiment]

Figure 1:
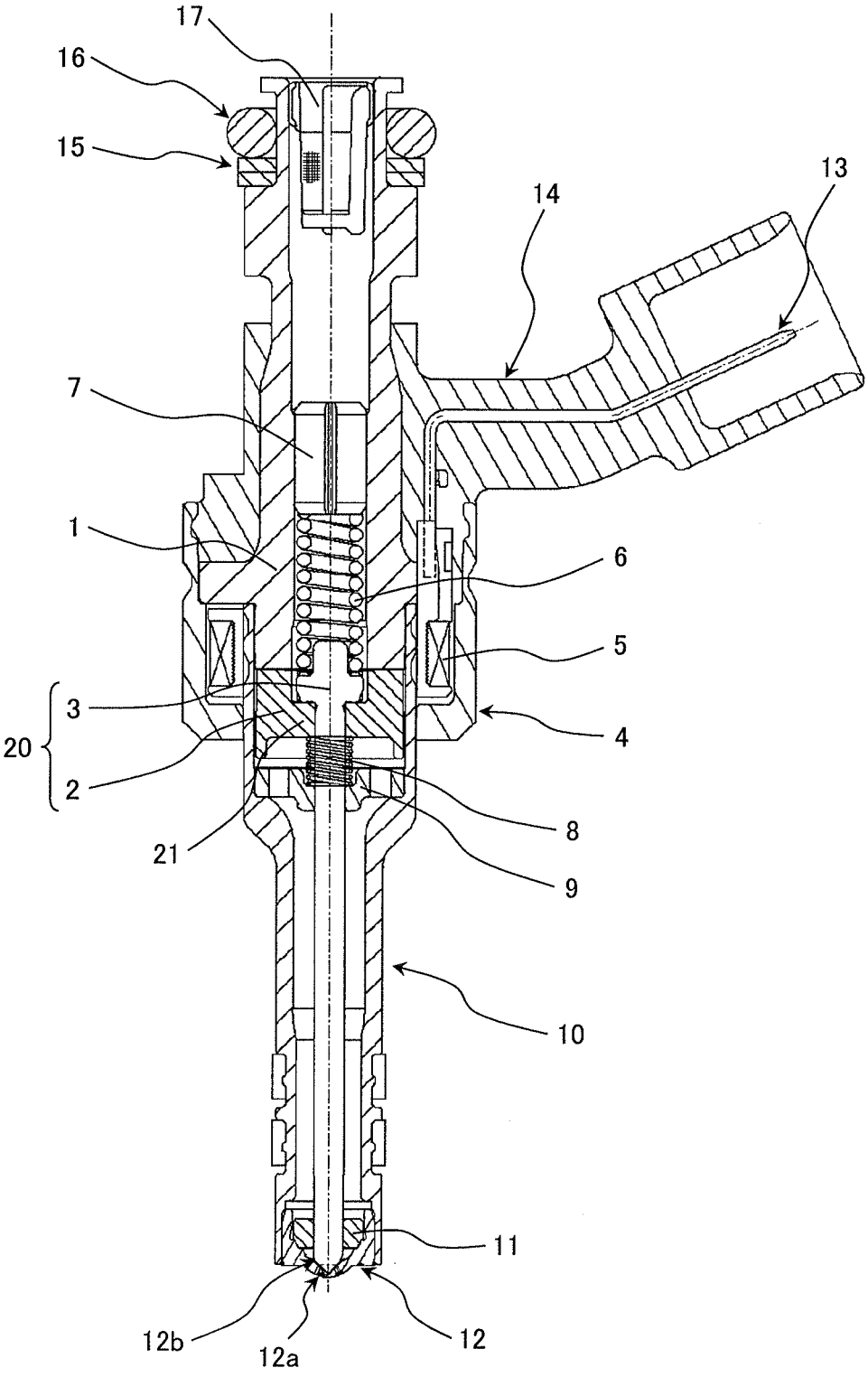
FIG. 1 is a cross-sectional view illustrating the overall configuration of an electromagnetic fuel injection valve according to a first embodiment of the present invention.

FIG. 1 is a cross-sectional view illustrating the overall configuration of an electromagnetic fuel injection valve according to a first embodiment of the present invention.

The electromagnetic fuel injection valve is configured so that a pressurized fuel is fed into its one end from a fuel pump (not illustrated) through a fuel delivery pipe (not illustrated), flows through its internal fuel passage, and is injected from its other end. As illustrated in FIG. 1, the electromagnetic fuel injection valve includes a housing 4 and a nozzle holder 10. A part of the nozzle holder 10 is press-fitted into the housing 4 and thereby fixed to housing 4. A stationary core 1 having an elongated hollow cylindrical structure is disposed in the housing 4. The interior of the stationary core 1 is used as the internal fuel passage. A movable valve element 20 is disposed in the nozzle holder 10. The movable valve element 20 is positioned concentrically with a central axis of the stationary core 1 to reciprocate within the nozzle holder 10. The movable valve element 20 includes a cylindrical movable core 2 and an elongated valve plug 3. The movable core 2 is positioned opposite a fuel outlet-side end face of the stationary core 1 at one end. The valve plug 3 is inserted through a hollow portion of the movable core 2 and configured so as to be capable of sitting on a valve seat 12 and leave the valve seat 12 alternately at one end of the nozzle holder 10. The movable core 2 and the valve plug 3 are formed separate from each other, and upon reciprocation of the movable valve element 20, they are configured to come into contact with each other and free the contact of them.

An electromagnetic coil 5 is arranged over outer peripheries of the stationary core 1 and movable core 2 to generate a driving force for the movable valve element 20. Electrical power is applied to the electromagnetic coil 5 through a terminal 13. The terminal 13 is passed through an exterior outer mold 14 with insert molding and connected to an external power supply. A fuel inlet above the stationary core 1 is provided with a filter 17, which eliminates foreign matter contained in the fuel, and with an O-ring 16 and a backup ring 15, which prevent fuel leakage.

An orifice member 12 is arranged at the end of the nozzle holder 10. Fuel injection orifices 12*a* are formed in the orifice member 12. A valve seat (seat) 12*b* on which the valve plug 3 sit is formed inside the orifice member 12. When the valve plug 3 sits on and leaves the valve seat 12*b* alternately, the inner fuel passage closes and opens alternately to control the amount of fuel injection from the fuel injection orifices 12*a*.

The movable core 2 is supported by a second return spring 8 on a valve plug guide 9 which is positioned below the movable core 2 and fixed within the nozzle holder 10. A circular shelf portion 21 is formed in the hollow portion of the movable core 2 to make the valve plug 3 engage with the shelf portion 21. The valve plug 3 engages with an upper surface of the shelf portion 21 so as to be retained by the upper surface of the shelf portion 21. An adjuster pin 7 is press-fitted into the hollow portion of the stationary core 1. A first return spring 6 is positioned between the adjuster pin 7 and the valve plug 3. When no magnetic attractive force is generated upon non-energization of the electromagnetic coil 5, the first and second return springs 6, 8 makes a state in which the movable core 2 and the valve plug 3 are engaged with each other and the first spring presses the valve plug 3 against the valve seat 12*b* to make a valve closing state.

When the electromagnetic coil 5 is energized through the terminal 13, a magnetic flux is generated to pass through the stationary core 1, the housing 4, and the movable core 2 so that a magnetic attractive force is generated between the stationary core 1, the housing 4, and the movable core 2. So the movable core 2 and the valve plug 3 retained by the movable core 2 move together, in a direction of leaving from the valve seat 12*b* (upward as viewed in FIG. 1), and thereby the upper end of the movable core 2 comes into contact with the stationary core 1 with impact. Further, when the upper end of the movable core 2 comes into contact with the lower end of the stationary core 1 to make a valve opening state, the valve plug 3, which receives acceleration from the movable core 2, moves independent of the movable core 2 in a direction of leaving from the shelf portion 21 of the movable core 2 (upward as viewed in FIG. 1). Then the load of the return spring 6 and the pressure of fuel brings the valve plug 3 back into contact with the movable core 2. As a result of valve opening, a required amount of fuel is injected through the fuel injection orifices 12*a*. An impact occurs due to the magnetic attractive force and spring force when the movable core 2 comes into contact with the stationary core 1 and when the movable core 2 comes back into contact with the valve plug 3.

Figure 2:
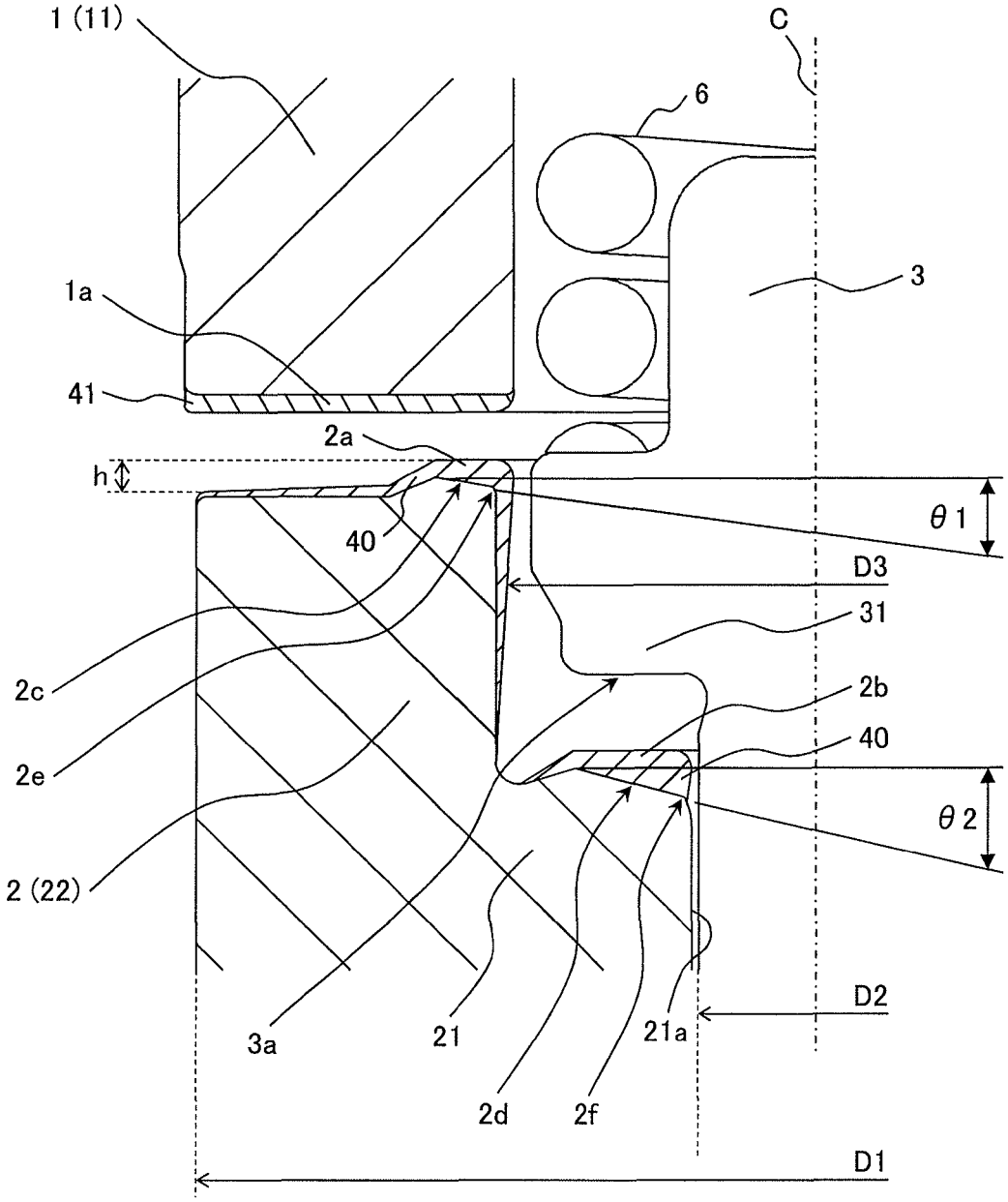
FIG. 2 is an enlarged cross-sectional view illustrating an impact surface of a movable core of the electromagnetic fuel injection valve illustrated in FIG. 1 and its surroundings.

FIG. 2 is an enlarged cross-sectional view illustrating an impact surface of the movable core 2 of the electromagnetic fuel injection valve illustrated in FIG. 1 and surroundings.

As illustrated in FIG. 2, the movable core 2 includes the shelf portion 21 that is circular in shape. The shelf portion 21 is formed in the hollow portion of the movable core 2 into which a part of the valve plug 3 is to be inserted. The valve plug 3 is provided with an engagement portion 31. The engagement portion 31 is positioned above the shelf portion 21 (on the first return spring 6-side), and the engagement portion 31 has an outer diameter formed larger than an inner diameter of the shelf portion 21 to engage with the upper surface of the shelf portion 21 thereby to retain the valve plug 3. The circular upper end face of the movable core 2 is positioned opposite the lower end face 1*a* of the stationary core 1, and acts as a first impact surface (hereinafter referred to as the upper impact surface 2*a*), which impacts with the lower end face of the stationary core (hereinafter referred to as the impact surface 1*a* of the stationary core) when the movable core 2 makes a reciprocation motion. The upper end face of the shelf portion 21 is positioned opposite the lower end face 3*a* of the engagement portion 31 of the valve plug 3, and acts as a second impact surface (hereinafter referred to as the inner impact surface 2*b*), which impacts with the lower end face of the engagement portion 31 (hereinafter referred to as the impact surface 3*a* of the valve plug 3) when the movable core 2 and the valve plug 3 makes a relative motion therebetween.

In the present embodiment, it is designed that an outer diameter D1 of the movable core 2 is approximately 10.4 mm, an inner diameter D2 as a small-diameter portion of the hollow portion (an inner diameter of a valve plug insertion hole below the shelf portion 21) is approximately 2.1 mm, and an inner diameter D3 of a large-diameter portion of the hollow portion (an diameter of a hole above the shelf portion 21) is approximately 5.4 mm. In the circular upper end face of the movable core 2, an approximately 0.35 mm width portion from an innermost point thereof is formed slightly higher than the other portion outside the 0.35 mm width portion (the height h is approximately 0.02 mm after a later-described chromium film layer is formed). Such a slightly higher surface acts as the upper impact surface 2*a*. Meanwhile, in the circular upper surface of the shelf portion 21, an approximately 0.99 mm width portion from the innermost point thereof acts as the inner impact surface 2*b* with which the valve plug 3 impacts.

The movable core 2 is provided with a rigid chromium film layer (e.g., a hard chromium film layer) 40 to be the upper impact surface 2*a* and the inner impact surface 2*b* on a movable core base material 22 made of ferrite electromagnetic stainless steel (e.g., KM35FL). The thickness of the chromium film layer 40 is described later. The stationary core 1 is provided with a rigid chromium film layer (e.g., hard chromium film layer) 41 to be the impact surface 1*a* on a stationary core base material 11 made of ferrite electromagnetic stainless steel (e.g., KM35FL). The chromium film layers 40, 41 are provided to prevent wear of the movable core 2 and the stationary core 1 due to an impact between the movable core 2 and the stationary core 1 and an impact between the movable core 2 and the valve plug 3. By using chromium as a material for the film layers that provide an improved wear resistance, it is possible to improve a property of contact between the movable core base material 22 and the stationary base material 11. In the present embodiment, it is designed that the chromium film layer 40 is 5 to 10 μm in thickness. Regarding the valve plug 3, it since is made of hard stainless steel (e.g., SUS420J2) capable of preventing wear of itself due to the impact between the valve plug 3 and movable core 2, no chromium film layer is formed on the impact surface 3*a* of the valve plug 3.

Electroplating is used as a method of performing a chromium film coating process. Electroplating is performed by a positive electrode (not illustrated) being disposed on a central axis C of the movable core base material 22 and a negative electrode being connected with the movable core base material 22. Incidentally, in the movable core base material 22, its inner wall 21*a* below the shelf portion 21 is masked in advance of electrical energization between the electrodes for electroplating to prevent its inner wall 21*a* from forming a chromium film layer 40. When electrical energization occurs between the electrodes, it is possible to form the chromium film layer 40 on the upper end face of the movable core base material 22 and on the upper surface of the shelf portion 21 by a single process. Note that the chromium film coating process for the impact surface 1*a* of the stationary core is performed separately from the chromium film coating process for the movable core 2 because a planar positive electrode is positioned opposite the impact surface 1*a* of the stationary core 1.

Incidentally, regarding the thicknesses of the chromium film layer 40 as the upper impact surface 2*a* and the inner impact surface 2*b* in the movable core 2, if there is no consideration, they tend to increase with a decrease at a distance from the positive electrode for electroplating. The film thickness further increases due to the concentration of current density, particularly at an angular portion 2*e*, which is a boundary between the upper end face and the inner wall in the movable core base material 22, and at an angular portion 2*f*, which is a boundary between the upper surface and the inner wall in the shelf portion 21.

With consideration for such a tendency, the present embodiment is configured so that surfaces 2*c*, 2*d* of the movable core base material 22, on which the upper impact surface 2*a* and the inner impact surface 2*b* are formed after chromium film coating, are sloped beforehand as follows. The sloped surfaces 2*c*, 2*d* of the movable core base material 22 have a reverse gradient amount with respect to a gradient amount of the chromium film layer 40 (gradient of film thickness) whose thickness gradually increases toward the central axis C of the movable core 2. In other words, the sloped surfaces 2*c*, 2*d* are formed on the end face of the movable core base material 22 so that each of the upper impact surface 2*a* and the inner impact surface 2*b* has a flat surface with little slope cancelling the gradient of thickness of the chromium film layer 40 after chromium film coating. The gradient amounts of the sloped surfaces 2*c*, 2*d* are calculated in accordance with the distance from the positive electrode of the electroplating disposed on the central axis C and with current density distribution on the upper impact surface 2*a* and the inner impact surface 2*b*.

The sloped surfaces 2*c*, 2*d* of the movable core base material 22 are tapered and sloped downward from the outside diameter to the inside diameter. Further, as the current density on the inner impact surface 2*b* (sloped surface 2*d*), which is closer to the positive electrode than the upper impact surface 2*a*, is higher than the current density on the upper impact surface 2*a* (sloped surface 2*c*), the gradient of the thickness of the chromium film layer 40 on the inner impact surface 2*b* is greater than the gradient of the thickness of the chromium film layer 40 on the upper impact surface 2*a*. Consequently, an angle θ1 of the sloped surface 2*c* is smaller than an angle θ2 of the sloped surface 2*d*. In the present embodiment, it is designed that the angle θ2 is approximately two times the angle θ1. This ensures that each of the impact surfaces 2*a*, 2*b* can have a flat surface with little slope even if the upper impact surface 2*a* and the inner impact surface 2*b* are simultaneously formed with chromium film.

The angular portions 2*e*, 2*f* are chamfered to have a gentle curvature. This reduces the concentration of current density at the angular portion 2*e* for the upper impact surface 2*a* and at the angular portion 2*f* for the inner impact surface 2*b*, thereby making it possible to prevent a local increase in the film thickness of the chromium film layer 40 at the angular portions 2*e*, 2*f*.

As described above, the electromagnetic fuel injection valve according to the present embodiment is configured so that the surfaces 2*c*, 2*d* of the movable core base material 22, on which the upper impact surface 2*a* and the inner impact surface 2*b* are formed, are sloped to have the reverse gradient amount with respect to the gradient amount of the chromium film layer 40 whose thickness gradually increases toward the central axis C of the movable core 2. Thereby, each of the upper impact surface 2*a* and the inner impact surface 2*b* has a flat surface with little slope cancelling between the slope of the chromium film layer 40 and the slopes of the surfaces 2*c*, 2*d*. This makes it possible to prevent the impact surfaces 2*a*, 2*b* from suffering plastic deformation, thereby prevention fluctuations in the amount of fuel injection. Further, in the present embodiment, a single film coating process is performed to form the chromium film layer on the upper impact surface 2*a* and the inner impact surface 2*b* simultaneously so that each of the upper impact surface 2*a* and the inner impact surface 2*b* in the movable core 2 can have a flat surface with little slope. Therefore, flat impact surfaces can be formed at low cost.

In the present embodiment, explained is that a single chromium film coating process is performed with one positive electrode inserted in the movable core 2 along the central axis C of the movable core 2. Alternatively, however, separate positive electrodes may be used to coat chromium film on the upper impact surface 2*a* and the inner impact surface 2*b* in the movable core 2.

[Second Embodiment]

Figure 3:
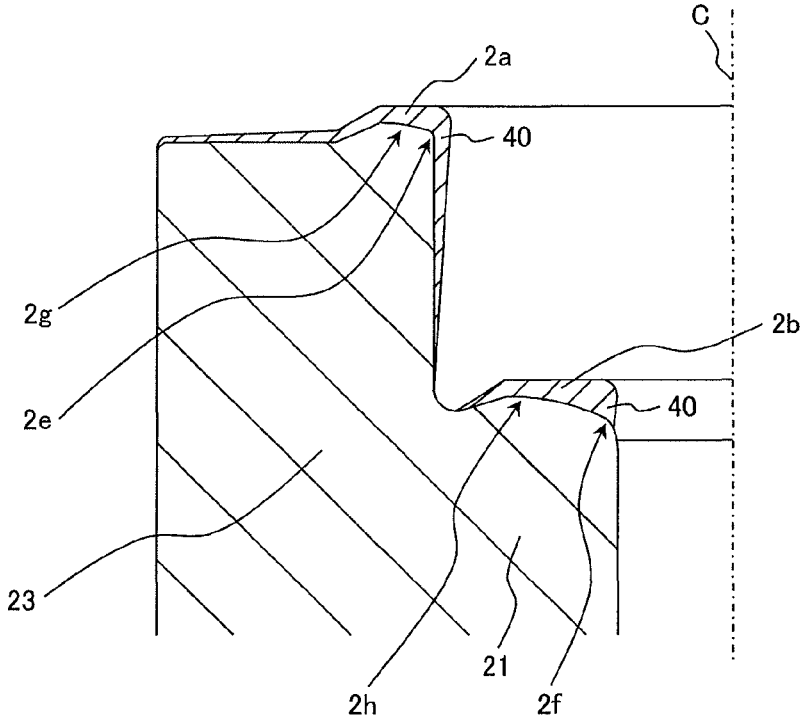
FIG. 3 is an enlarged cross-sectional view illustrating an impact surface of a movable core of an electromagnetic fuel injection valve according to a second embodiment of the present invention and its surroundings.

FIG. 3 is a cross-sectional view illustrating the impact surfaces of the movable core of the electromagnetic fuel injection valve according to a second embodiment of the present invention. The electromagnetic fuel injection valve according to the second embodiment has basically the same configuration as the electromagnetic fuel injection valve described with reference to FIGS. 1 and 2. However, as illustrated in FIG. 3, the sloped surfaces of the movable core base material 23 differ in shape from the sloped surfaces described with reference to FIG. 2.

The electromagnetic fuel injection valve according to the present embodiment is configured so that the sloped surfaces 2*g*, 2*h* of the movable core base material 23, on which the upper impact surface 2*a* and the inner impact surface 2*b* formed, are curved to have a gentle curvature. In the present embodiment, each of the upper impact surface 2*a* and the inner impact surface 2*b* in the movable core 2 can also have a flat surface with little slope by performing a single film coating process, as is the case with the movable core 2 described with reference to FIG. 2. This makes it possible to reduce fluctuations in the fuel injection amount at low cost.

[Third Embodiment]

Figure 4:
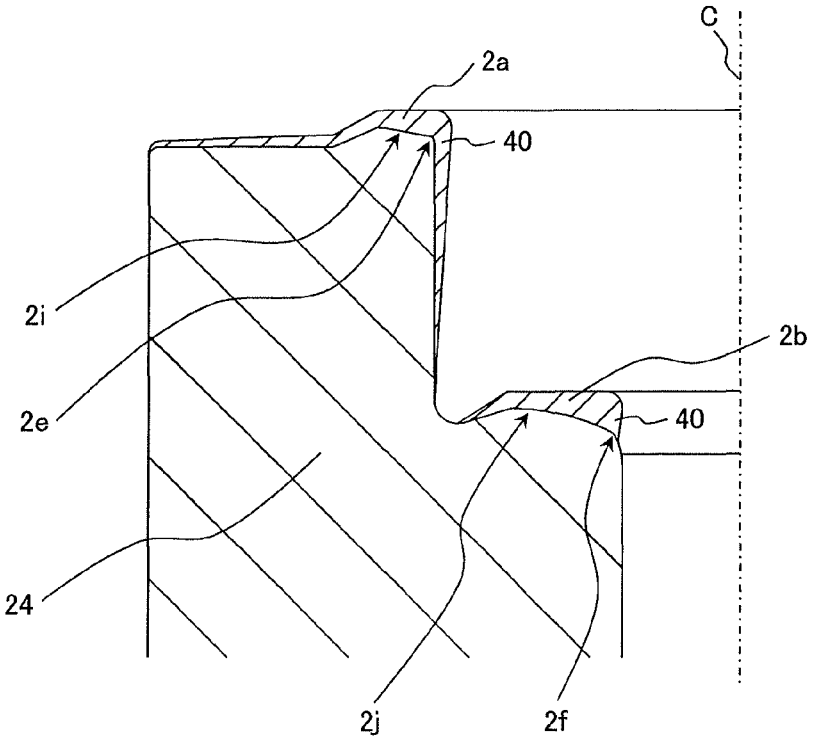
FIG. 4 is an enlarged cross-sectional view illustrating an impact surface of a movable core of an electromagnetic fuel injection valve according to a third embodiment of the present invention.

FIG. 4 is a cross-sectional view illustrating the impact surfaces of the movable core of the electromagnetic fuel injection valve according to a third embodiment of the present invention. The electromagnetic fuel injection valve according to the third embodiment has basically the same configuration as the electromagnetic fuel injection valve described with reference to FIGS. 1 and 2. However, as illustrated in FIG. 4, the sloped surfaces of the movable core base material 24 differ in shape from the sloped surfaces described with reference to FIG. 2.

The electromagnetic fuel injection valve according to the present embodiment is configured so that, in the sloped surfaces 2*i*, 2*j* of the movable core base material 24, the sloped surface 2*i*, on which the upper impact surface 2*a* is formed, is tapered downward from its outside diameter to its inside diameter, and the sloped surface 2*j*, on which the inner impact surface 2*b* is formed, is curved to have a gentle curvature. In the present embodiment, each of the upper impact surface 2*a* and the inner impact surface 2*b* in the movable core 2 can also have a flat surface with little slope by performing a single film coating process, as is the case with the movable core 2 described with reference to FIG. 2. This makes it possible to reduce fluctuations in the fuel injection amount at low cost.

The shapes of the sloped surfaces of the movable core base material 24 according to the present embodiment may alternatively be interchanged. More specifically, in the movable core base material 24, the sloped surface, on which the upper impact surface 2*a* is formed, is curved in shape, and the sloped surface, on which the inner impact surface 2*b* is formed, is tapered downward from its outside diameter to its inside diameter.

[Fourth Embodiment]

Figure 5:
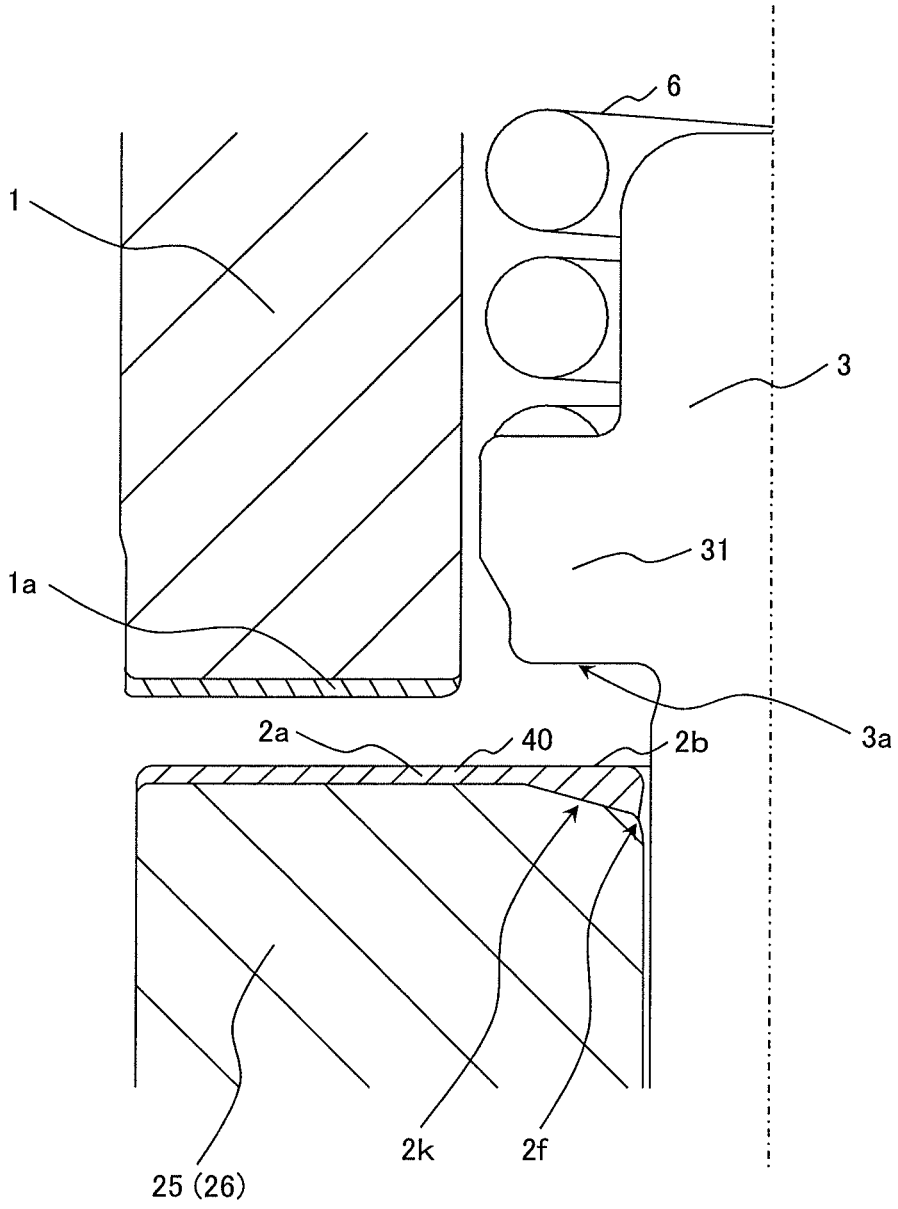
FIG. 5 is an enlarged cross-sectional view illustrating an impact surface of a movable core of an electromagnetic fuel injection valve according to a fourth embodiment of the present invention.

FIG. 5 is a cross-sectional view illustrating the impact surfaces of the movable core of the electromagnetic fuel injection valve according to a fourth embodiment of the present invention. The electromagnetic fuel injection valve according to the fourth embodiment has basically the same configuration as the electromagnetic fuel injection valve described with reference to FIGS. 1 and 2. However, as illustrated in FIG. 5, the movable element 25 differs in shape from the movable core 2 described with reference to FIGS. 1 and 2.

As illustrated in FIG. 5, the movable core 25 is configured so that the first impact surface (upper impact surface) 2*a*, which impacts with the stationary core 1, and the second impact surface (inner impact surface) 2*b*, which impacts with the engagement portion 31 of the valve plug 3, are formed on the same plane. More specifically, the movable core 25 does not have the shelf portion but is substantially cylindrical in shape while the second impact surface 2*b* is formed on the upper end face of the movable core 25 and disposed coaxially and circularly on the inner side of the first impact surface 2*a*. However, the sloped surface 2*k* on the movable core base material 26, on which the second impact surface 2*b* is formed, is formed only on the innermost-side portion of the upper end face of the cylindrical movable core. On the other hand, a portion of the movable core base material 26, on which the first impact surface 2*a* is formed, is formed flat without slope.

In the present embodiment, each of the upper impact surface 2*a* and the inner impact surface 2*b* in the movable core 2 can also have a flat surface with little slope by performing a single film coating process, as is the case with the movable core 2 described with reference to FIG. 2. This makes it possible to reduce fluctuations in the fuel injection amount at low cost.

EXPLANATION OF REFERENCE NUMERALS AND SYMBOLS

1 . . . Stationary core
2 . . . Movable core
3 . . . Valve plug
2*a* . . . Upper impact surface
2*b* . . . Inner impact surface
2*c* . . . Sloped surface of movable core base material for upper impact surface
2*d* . . . Sloped surface of movable core base material for inner impact surface
2*e* . . . Angular portion of upper impact surface
2*f* . . . Angular portion of inner impact surface

The invention claimed is:

1. An electromagnetic fuel injection valve comprising:

a stationary core; and a movable valve element that comprises a movable core which has a cylindrical structure, and a valve body, which is formed separate from the movable core and retained on a central axis side of the valve body, wherein the movable core is coated with a chromium film layer, an end face of a movable core base material having a protruding part which protrudes from the movable core to the stationary core, the protruding part being provided with a sloped surface on the central axis side of the valve body, the sloped surface sloping toward the central axis side of the valve body from a stationary core side to a movable core side, and one end face of the chromium film layer on the sloped surface of the protruding part impacts with an end face of the stationary core, another end face of the chromium film layer on the sloped surface of the protruding part sloping toward the central axis from the stationary core side to the movable core side.

2. The electromagnetic fuel injection valve according to claim 1, wherein the movable core includes a shelf portion that is circularly formed in a hollow portion of the cylindrical structure to retain the valve body with an end face of the shelf portion, the valve body has an engagement portion that engages with the end face of the shelf portion, a first impact surface is disposed on an upper end face on an outer circumferential side of the movable valve element, and a second impact surface is disposed on the end face of the shelf portion.

3. The electromagnetic fuel injection valve according to claim 2, wherein the first and second impact surfaces of the movable core are formed on the same end face that opposes the stationary core, and the sloped surface of the movable core base material is formed only on the second impact surface side.

4. The electromagnetic fuel injection valve according to claim 2, wherein an angular portion on an inner circumference side of the end face of the movable core base material, on which at least either the first impact surface or the second impact surface is formed, is chamfered to have a gentle curvature.

5. The electromagnetic fuel injection valve according to claim 1, wherein the sloped surface of the movable core base material is tapered downward in shape.

6. The electromagnetic fuel injection valve according to claim 1, wherein the sloped surface of the movable core base material is formed to have a curve that gradually becomes low toward an inner circumferential side of the movable element.

7. The electromagnetic fuel injection valve according to claim 1, wherein the end face of the movable core base material is provided with a second sloped surface on the central axis side of the valve body, the second sloped surface sloping toward the central axis side from the stationary core side to the movable core side, and one end face of the chromium film layer on the second sloped surface impacts with the end face of the valve body, the another end face of the chromium film layer on the second sloped surface sloping toward the central axis from the stationary core side to the movable core side.

8. The electromagnetic fuel injection valve according to claim 1, wherein the one end face of the chromium film layer on the sloped surface is formed to be parallel with the end face of the stationary core.

9. The electromagnetic fuel injection valve according to claim 1, wherein the one end face of the chromium film layer on the second sloped surface is formed to be parallel with the end face of the valve body.

10. The electromagnetic fuel injection valve according to claim 7, wherein a first inclination angle of the another end face of the chromium film layer on the sloped surface is smaller than a second inclination angle of the another end face of the chromium film layer on a second sloped surface.

* * * * *